United States Patent [19]

Leifeld

[11] Patent Number: 4,506,413

[45] Date of Patent: Mar. 26, 1985

[54] APPARATUS FOR REGULATING FIBER QUANTITIES SUPPLIED TO A TEXTILE MACHINE

[75] Inventor: Ferdinand Leifeld, Kempen, Fed. Rep. of Germany

[73] Assignee: Trützschler GmbH & Co. KG, Mönchengladbach, Fed. Rep. of Germany

[21] Appl. No.: 467,600

[22] Filed: Feb. 18, 1983

[30] Foreign Application Priority Data

Feb. 18, 1982 [DE] Fed. Rep. of Germany ..... 3205776

[51] Int. Cl.[3] ..... D01H 5/38

[52] U.S. Cl. ..... 19/105; 19/240; 19/300

[58] Field of Search ..... 19/105, 240, 300

[56] References Cited

U.S. PATENT DOCUMENTS 4,438,548 3/1984 Grunder ..... 19/105

*Primary Examiner*—Louis K. Rimrodt

*Attorney, Agent, or Firm*—Spencer & Frank

[57] ABSTRACT

An apparatus for regulating fiber quantities supplied to a textile machine as a fiber layer, comprises a sensor device for mechanically sensing thickness variations of the fiber layer at a plurality of locations along the layer width and emitting individual mechanical signals representing the magnitude of thickness variations at each location, a transducer arrangement connected to the sensor device for converting each individual mechanical signal into an individual electric signal, a signal adder connected to the transducer arrangement for combining the individual signals into a joint electric signal, a regulator arrangement connected to the signal adder for comparing the joint electric signal representing an actual value with a predetermined desired value of fiber layer thickness for generating a setting signal, a fiber layer delivery device, and a setting device connected to the regulator arrangement and the fiber layer delivery device for controlling the setting device by the setting signals, whereby fiber quantities of the fiber layer are regulated as a function of the thickness variations of the fiber layer.

10 Claims, 5 Drawing Figures

4506413
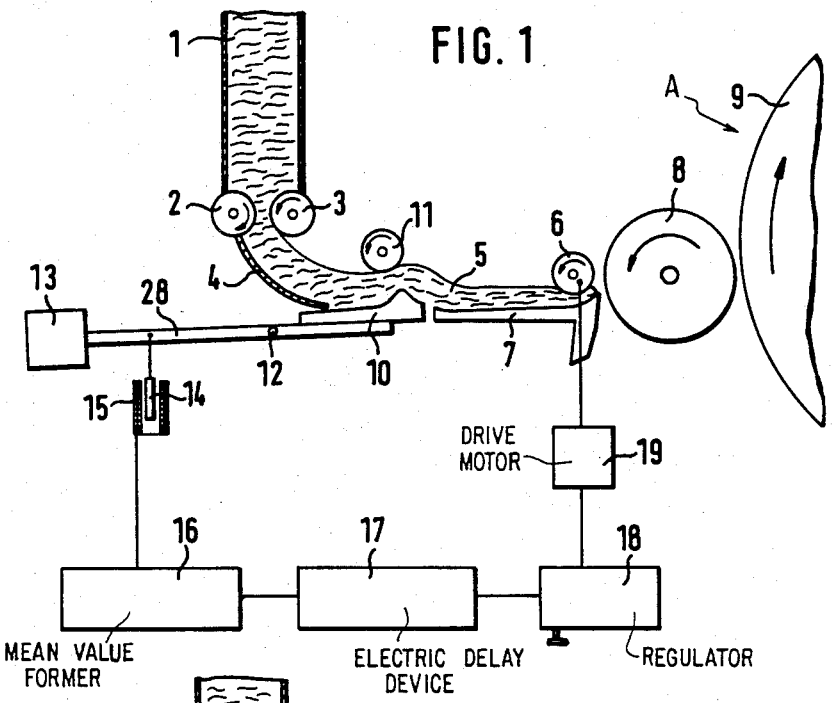
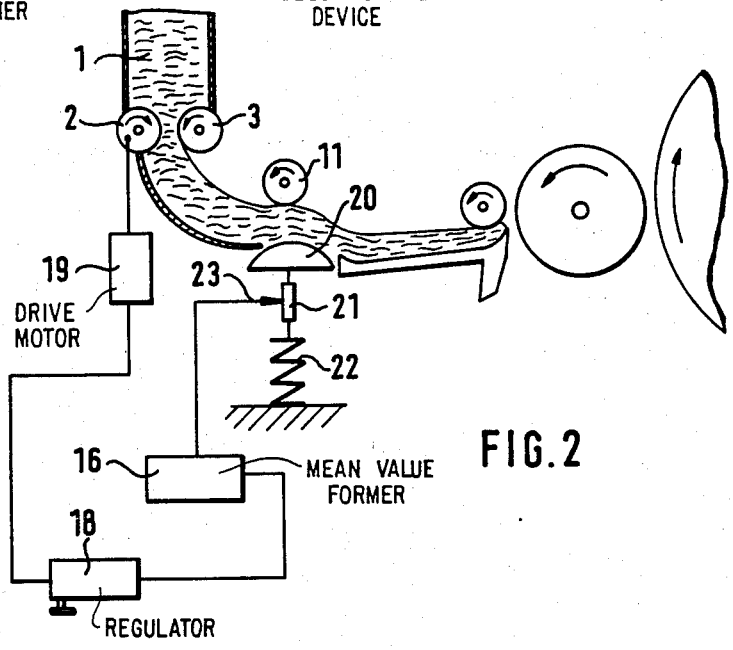
FIG. 2

APPARATUS FOR REGULATING FIBER QUANTITIES SUPPLIED TO A TEXTILE MACHINE

BACKGROUND OF THE INVENTION

This invention relates to an apparatus for regulating the supply of fiber quantities to a textile machine, particularly the quantities of fiber in a fiber lap fed to a card or a roller card unit (hereafter collectively referred to as a carding machine). The apparatus includes a measuring device extending over the width of a fiber layer surface for mechanically sensing the thickness deviations at several locations along the width. The sensed signals are, prior to comparing them with a predetermined desired value, combined by a mean value forming arrangement and, as a function of the deviation of the measured actual (mean) value from the desired value, the fiber quantity to be supplied to the textile machine is altered.

In a known apparatus of the above-outlined type excursions of levers connected with side-by-side arranged lap supporting trays represent thickness variations at several locations across the width of the fiber lap. The deflections of the individual levers are combined by means of a lever system and processed mechanically. Such a system, however, is structurally complex and its accuracy is inherently limited.

SUMMARY OF THE INVENTION

It is an object of the invention to provide an improved apparatus of the above-outlined type wherein the accuracy of the fiber quantity regulation is improved in a structurally simple manner.

This object and others to become apparent as the specification progresses, are accomplished by the invention, according to which, briefly stated, upon thickness deviation of the fiber material supplied to the textile machine, the sensed individual mechanical signals are transformed into individual electrical signals which are electrically added to produce a combined electric signal.

By converting mechanical signals into electric signals, deviations in the fiber lap to be supplied to a carding machine may be measured in a structurally simple manner. Further, an electric processing of the measuring signals makes possible shorter response periods for the control or regulation of a setting member so that the accuracy (degree) of the fiber quantity regulation is significantly increased.

BRIEF DESCRIPTION OF THE DRAWINGS

FIG. 1 is a schematic side elevational view, including a block diagram, of a preferred embodiment of the invention.

FIG. 2 is a schematic side elevational view, including a block diagram, of another preferred embodiment of the invention.

DESCRIPTION OF THE PREFERRED EMBODIMENTS

Figure 3:
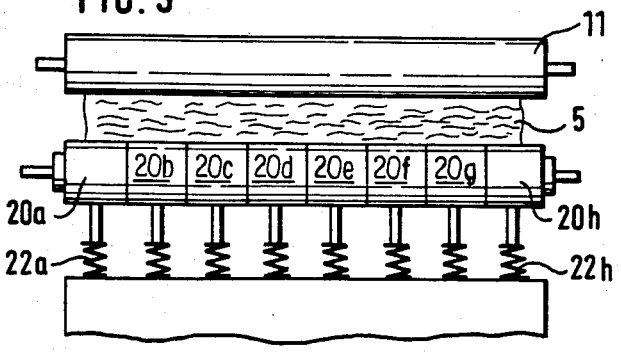
FIG. 3 is a schematic front elevational view of components illustrated in FIG. 2.

Turning now to FIG. 1, there is shown a feed chute 1 of a pneumatic fiber tuft delivering apparatus which is connected to a carding machine generally indicated at A. At the lower end of the feed chute 1 there are arranged two feed rollers 2 and 3 underneath which there is situated an arcuate support table 4 which changes the substantially vertical orientation of a fiber lap 5 delivered by the rollers 2 and 3 to a substantially horizontal orientation. Downstream of the support table 4 there is arranged a lap feeding device formed of a feed roller 6 and a feeding table 7. Downstream of the feeding arrangements 6, 7 (as viewed in the direction of lap advance) there is arranged a lickerin 8 and a cylinder 9 of the carding machine A.

Between the support table 4 and the feed table 7 there are provided a plurality of tray levers 10 situated closely side-by-side across the width of the fiber lap 5. The orientation and shape of the tray levers 10 are of significance: they engage the fiber lap from below, underneath a stationarily arranged, rotatable and, if desired, driven support roller (counter roller) 11, providing for a reliable grasping of the fiber tufts between the tray levers 10 on the one hand and the support roller 11 on the other hand. Each tray lever 10 is secured to one end of a lever arm 11 rotatable about a pivot 12 which is arranged approximately in the middle of the lever arm. The lever arm 11 is loaded (biased) at its other end by a weight 13 or a spring. Between the pivot 12 and the weight 13 each lever arm 11 carries an armature 14 which cooperates with a solenoid 15. Each solenoid 15 is connected to a common mean value forming device 16 which, in turn, is connected to an electric delay device 17 such as an integral member and a regulator 18 known by itself. The delay device 17 may also be associated with the I-part (integrating part) of the regulator 18. The latter is connected with a drive motor 19 of the feed roller 6 of the carding machine.

During operation, thickness deviations of the fiber lap 5 are mechanically sensed at several locations by means of the individual tray levers 10 arranged across the width of the upper surface of the fiber lap 5. The individual mechanical signals are, by means of the armatures 14 and the associated solenoids 15 (functioning as transducers) converted into individual electric signals which, by means of the mean value forming device 16 are electrically added to form a combined electric signal (mean value). The combined signal is, with a delay effected by the delay device 17 applied to the regulator 18 and, after a comparison with a predetermined desired value, the rpm of the drive motor 19 of the feed roller 6 is altered (error compensation) so that more or less fiber material in the fiber lap is supplied to the carding machine. The mean values may be also integrated over time for compensating for long-wave errors.

Turning now to the embodiment illustrated in FIG. 2, there is provided a measuring member 20 having a convex support face oriented towards the support roller 11. On the convex support member 20 there is mounted a resistor 21 which is engaged by a compression spring 22 having a stationary support on its other end. With the resistor 21 there is associated a wiper arm 23 which is connected with the mean value forming device 16 which in turn is connected to the regulator 18. The latter sets the desired rpm of the drive motor 19 for the feed rollers 2 and 3 of the feed chute 1.

Turning now to FIG. 3, there are shown closely juxtapositioned measuring members 20*a* through 20*h* which, by means of springs 22*a* through 22*h* press the fiber lap 5 against the support roller 11. The width of each measuring member 20*a* through 20*h* may be, for example, 60 mm and they may number, for example 18.

Figure 4:
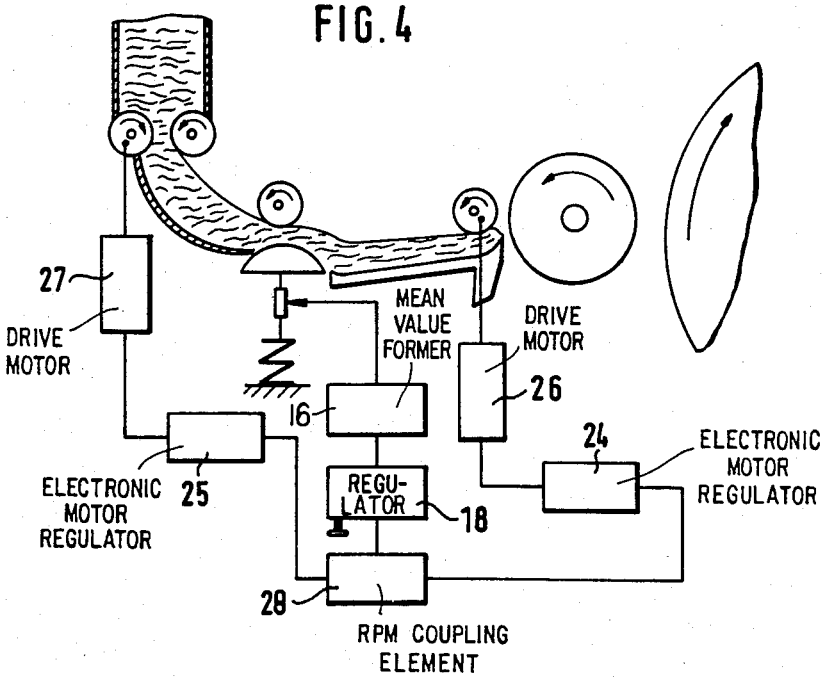
FIG. 4 is a schematic side elevational view, including a block diagram, of still another preferred embodiment of the invention.
Figure 5:
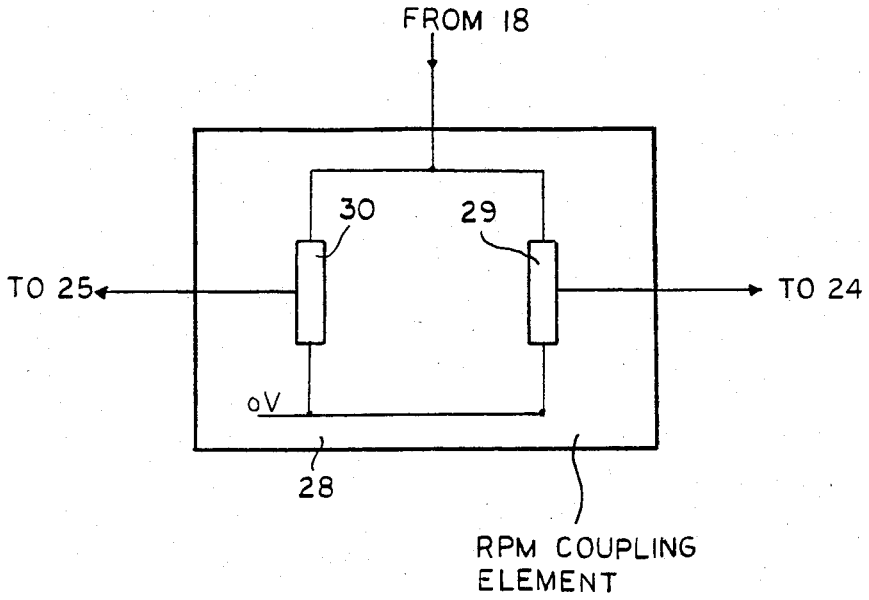
FIG. 5 is a block diagram showing details of a component illustrated in FIG. 4.

According to FIG. 4, the regulator 18 is connected to the input of an rpm coupling element 28 which, in turn, is connected to electronic motor regulators 24 and 25 which may be SIMOREG model rpm setters, manufactured by Siemens AG, Munich, Federal Republic of Germany. The motor regulators 24 and 25 are connected to rpm-variable drive motors 26 and 27 such as d.c. motors. As shown in FIG. 5, the rpm coupling element 28 has two potentiometers 29 and 30 connected to the electronic motor regulators 24 and 25, respectively, and also connected to the regulator 18. By means of the potentiometers 29, 30 the electronic motor regulators 24 and 25 can be separately set.

It is to be understood that it is within the scope of the invention to provide a measuring member above the fiber lap 5 in contradistinction to the embodiments described where the sensors are arranged underneath the fiber lap.

It will be understood that the above description of the present invention is suceptible to various modifications, changes and adaptations, and the same are intended to be comprehended within the meaning and range of equivalents of the appended claims.

What is claimed is:

1. In an apparatus for regulating fiber quantities supplied to a textile machine as a fiber layer of indeterminate length and determinate width, including sensor means for mechanically sensing thickness variations of said fiber layer at a plurality of locations along said width and emitting individual mechanical signals representing the magnitude of thickness variations at each location; and fiber layer delivery means; the improvement comprising (a) transducer means connected to said sensor means for converting each individual mechanical signal into an individual electric signal;

(b) signal adding means connected to said transducer means for combining the individual signals into a joint electric signal;

(c) regulator means connected to said signal adding means for comparing said joint electric signal representing an actual value with a predetermined desired value of fiber layer thickness for generating a setting signal; and (d) setting means connected to said regulator means and said fiber layer delivery means for controlling said setting means by said setting signal whereby fiber quantities of said fiber layer are regulated as a function of said thickness variations of said fiber layer.

2. An apparatus as defined in claim 1, wherein said fiber layer delivery means comprises a feed roller of a carding machine; said feed roller being arranged downstream of said sensor means as viewed in the direction of fiber feed; said setting means comprising a drive motor for said feed roller.

3. An apparatus as defined in claim 1, wherein said fiber layer delivery means comprises feed rollers of a fiber tuft supplying apparatus delivering a fiber lap to a carding machine; said feed rollers being arranged upstream of said sensor means as viewed in the direction of fiber feed; said setting means comprising a drive motor for at least one of said feed rollers.

4. An apparatus as defined in claim 1, wherein said fiber layer delivery means comprise first and second feed roller means; said first feed roller means forming part of a carding machine; said first feed roller means being arranged downstream of said sensor means as viewed in the direction of fiber feed; said second feed roller means forming part of a fiber tuft delivering apparatus supplying a fiber lap to said carding machine; said second feed roller means being arranged upstream of said sensor means as viewed in the direction of fiber feed; said setting means comprising first and second drive motor means; said first drive motor means being coupled to said first feed roller means for rotating said first feed roller means and said second drive motor means being coupled to said second feed roller means for driving said second feed roller means.

5. An apparatus as defined in claim 1, wherein said sensor means comprises a plurality of side-by-side arranged measuring elements extending along said width of the fiber layer at one side thereof; a counter roller extending along said width of the fiber layer at another, opposite side thereof and force-exerting means for resiliently urging each measuring element towards said counter roller.

6. An apparatus as defined in claim 5, wherein said transducer means comprises individual transducer elements operatively connected with each said measuring element for converting displacements of said measuring elements into individual electric signals.

7. An apparatus as defined in claim 6, wherein each transducer element comprises an armature attached to a respective said measuring element and a coil operatively coupled with said armature.

8. An apparatus as defined in claim 6, wherein said signal adding means comprises an electric mean value signal forming means connected to each said transducer element.

9. An apparatus as defined in claim 8, further comprising an electric delay device having an input connected to an output of said electric mean value signal forming means.

10. An apparatus as defined in claim 1, further wherein said regulator means comprises an rpm coupling element and an rpm setter; said setting means comprising an electric motor having an input connected to an output of said rpm setter.

* * * * *